US007101232B2

(12) United States Patent
Shimizu

(10) Patent No.: US 7,101,232 B2
(45) Date of Patent: Sep. 5, 2006

(54) EXTERNAL CONNECTION TERMINAL FIXING STRUCTURE WITH BRIDGING COMPONENT

(75) Inventor: Masahito Shimizu, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/924,963

(22) Filed: Aug. 25, 2004

(65) Prior Publication Data

US 2005/0037674 A1 Feb. 17, 2005

(30) Foreign Application Priority Data

Sep. 2, 2003 (JP) ..... 2003-310212

(51) Int. Cl.
*H01R 13/514* (2006.01)
*H01R 13/62* (2006.01)

(52) U.S. Cl. ..... 439/731; 439/299

(58) Field of Classification Search ..... 439/731, 439/76.1, 638, 299, 300, 521
See application file for complete search history.

(56) References Cited

U.S. PATENT DOCUMENTS 6,165,006 A * 12/2000 Yeh et al. ..... 439/490
6,241,534 B1 * 6/2001 Neer et al. ..... 439/76.1
6,652,312 B1 * 11/2003 Liegl et al. ..... 439/519
6,743,045 B1 * 6/2004 Hayashi et al. ..... 439/495
2003/0039109 A1 2/2003 Kitamura et al.

FOREIGN PATENT DOCUMENTS

| | | |
|---|---|---|
| CN | 1303225 A | 7/2001 |
| CN | 1328360 A | 12/2001 |
| EP | 1 128 489 | 8/2001 |
| JP | 6-68187 | 9/1994 |

* cited by examiner

*Primary Examiner*—Chandrika Prasad
(74) *Attorney, Agent, or Firm*—Young & Thompson

(57) ABSTRACT

A mobile terminal device includes a key side housing having operation buttons and a display side housing having a liquid crystal display module. The key side housing and the display side housing are coupled by a hinge device to be folded free. The key side housing consists of an upper case, a lower case and a printed circuit board. The upper and lower cases are engaged to each other to be opened or closed, and fastened to each other with screws 10 passing through the printed circuit board. The external connection terminal fixing structure of the mobile terminal device consists of external connection terminals which are fixed to the printed circuit board and charge terminals overlapped with the external connection terminals. The charge terminals are thick enough to bridge the gap between the external connection terminals and the upper case.

20 Claims, 3 Drawing Sheets

EXTERNAL CONNECTION TERMINAL FIXING STRUCTURE WITH BRIDGING COMPONENT

BACKGROUND OF THE INVENTION

1. Field of the Invention

The present invention relates to an external connection terminal fixing structure and a mobile terminal device. More specifically, the present invention relates to an external connection terminal fixing structure which can prevent a printed circuit board fixing an external connection terminal from fault, and a mobile terminal device using the same.

2. Description of the Related Art

A conventional mobile terminal device is equipped with an external connection terminal which outputs and inputs data in the device housing. In general, the external connection terminal is fixed by soldering onto an electric conduction pattern which is prepared in a printed circuit board in the housing. When an external connector is connected to the external connection terminal, a force by insertion and extraction of the external connector joins a solder joint portion or an electric conduction pattern of the printed circuit board fixing the external connection terminal, and there is a problem that the crack of the solder joint portion and peeling of an electric conduction pattern arise.

As an example solving such problem, it is carried out that a gap between the external connection terminal mounted on the printed circuit board and a case for containing the printed circuit board is bridged by using a processed auxiliary component (for example, see Japanese Published Unexamined Utility-Model Application No. h6-68187 (pp. 6 to 8, FIGS. 2 and 3)).

In the prior art, as shown in FIGS. 5A and 5B, the electronic device 30 consists of the upper case 31 and the lower case 32 coupled with each other to be opened or closed, the external connection terminal 33 is mounted by soldering on the printed circuit board 34 contained the lower case 32. The external connection terminal 33 consists of a jack part 33*a*, a body 33*b*, and a attachment part 35. The jack part 33*a* of the external connection terminal 33 is projected from the side of the electronic device 30 and is connected with an external connector (not shown).

The upper case 31 is provided with a box-like rib 36 in the position opposite the attachment part 35 of the external connection terminal 33. The box-like rib 36 consists of an outside rib 36*a* and an inside rib 36*b* inserting the attachment part 35 in between, and a coupling part 36*c* pushing the top surface of the attachment part 35.

In the electric device 30 above-mentioned, when the upper case 31 and the lower case 32 are fastened to each other with screws (not shown), the external connection terminal 33 is pushed onto the printed circuit board 34 by the box-like rib 36. When the external connector is connected to the jack parts 33*a* of the external connection terminal 33, even if a force of the upper-and-lower or right-and-left direction by insertion and extraction of the external connector is added, the force is absorbed as the whole electric device 30 by transmitting the force to the upper case 31 via the coupling part 36*c* pushing the external connection terminal 33. That is, the force does not join only the connection portion fixing the external connection terminal 33, faults such as a crack of the solder joint portion and peeling of an electric conduction pattern can be prevented.

However, since it is necessary to form the box-like rib 36 on the upper case 31 for pushing the external connection terminal 33 fixed onto the printed circuit board 34. Therefore, there is a problem that costs for forming the upper case 31, manufacturing of a coupling part matching with the formed portion, manufacturing of complicated components, and assembling parts such as the coupling part occurs.

SUMMARY OF THE INVENTION

An object of the present invention is to provide an external connection terminal fixing structure which can prevent from cracking of a solder joint portion and peeling of an electric conduction pattern without needing complicated components and many steps of assembling based on a force by connection of an external connector, and a mobile terminal device using the same.

To achieve the above object, an external connection terminal fixing structure of the present invention comprising a printed circuit board, a lower case and an upper case containing the printed circuit board, an external connection terminal fixed to the printed circuit board, and an auxiliary component overlapped with the external connection terminal and contacted with the upper case, wherein the auxiliary component has a thickness enough to bridge a gap between the printed circuit board and the upper case.

The lower case and the upper case have a cut edge (opening) at the position where the external connection terminal is fixed to the printed circuit board so that one side of the external connection terminal is exposed.

The external connection terminal provides an electric jack which an external connector is connected through the cut edge and is fixed to an electric conduction pattern of the printed circuit board by soldering.

The upper case has an opening at the position where the auxiliary component contacts to the upper case so that one side of the auxiliary component is outside exposed.

The auxiliary component has an electrode surface inputting a charge current through another opening, a concave portion for overlapping the external connection terminal from the top, and is mounted onto an electric conduction pattern of the printed circuit board.

In a mobile terminal device, the external connection terminal fixing structure is incorporated as a unit of device components.

In the external connection terminal fixing structure and the mobile terminal device constituted as mentioned above, a force by insertion and extraction of the external connector connected to the external connection terminal is absorbed by the lower case and the upper case transmitted via the auxiliary component, by bridging the gap with the auxiliary component between the external connection terminal mounted on the printed circuit board and the upper case. Hence, since the force does not join only the connection portion which fixes the external connection terminal, faults such as a crack of a solder joint portion and peeling of an electric conduction pattern of the printed circuit board fixing the external connection terminal can be prevented.

BRIEF DESCRIPTION OF THE DRAWINGS

The above and other objects, features and advantages of the present invention will become more apparent from the following detailed description when taken in conjunction with the accompanying drawings wherein.

DETAILED DESCRIPTION OF THE PREFERRED EMBODIMENTS

Figure 1:
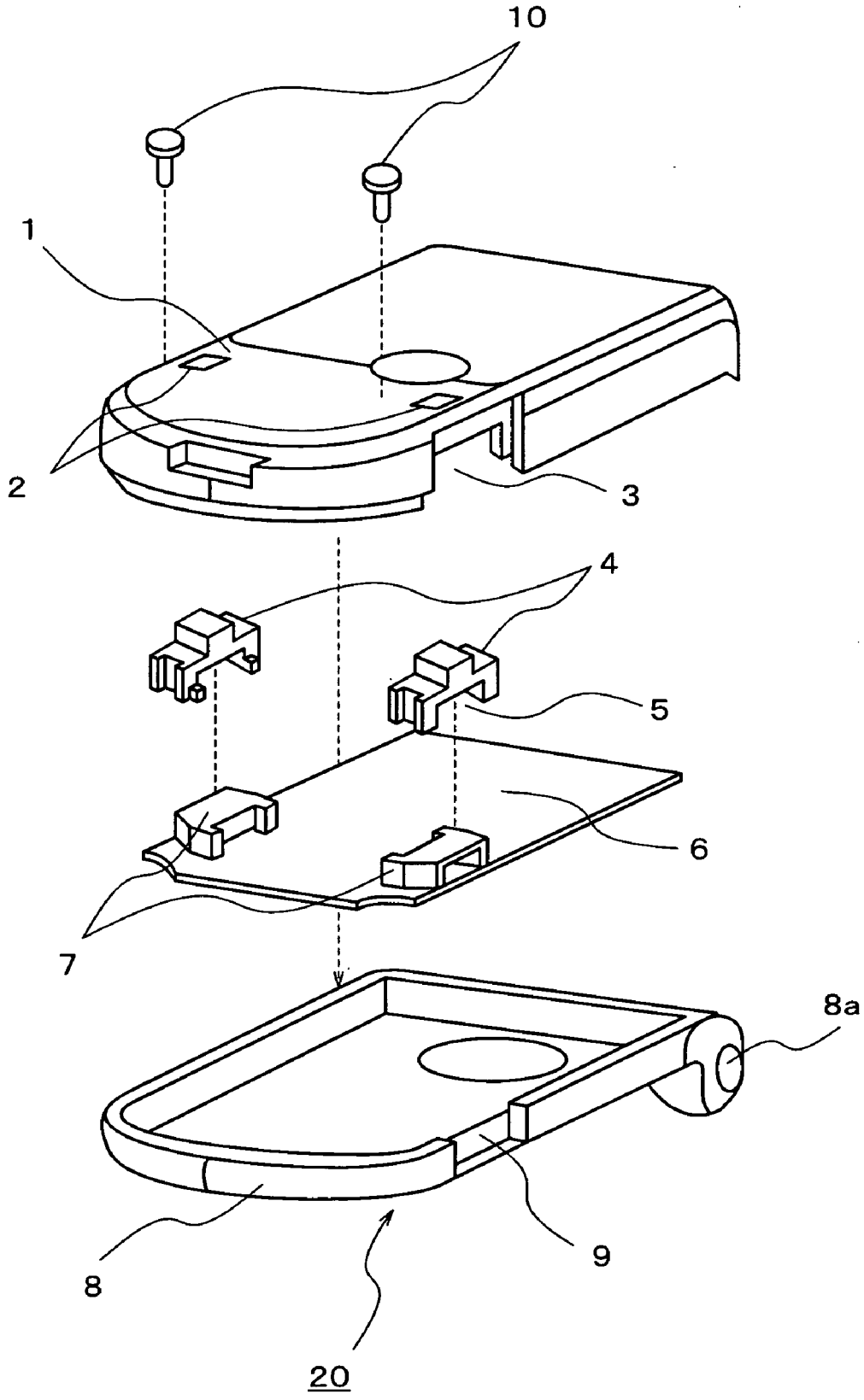
FIG. 1 is an exploded perspective view showing an external connection terminal fixing structure of a first embodiment used in a mobile terminal device of the present invention.

The present invention will be described with reference to the drawings. FIG. 1 is an exploded perspective view showing an external connection terminal fixing structure of a first embodiment used in a mobile terminal device of the present invention.

Referring to FIG. 1, a mobile terminal device of the present invention consists of a key side housing 20 having operation buttons et alia and a display side housing (not shown) having a liquid crystal display module. The key side housing 20 and the display side housing are coupled by a hinge device 8*a* to be folded free.

The following explanation shows the composition only about the key side housing 20 equipped with the external connection terminal fixed structure concerning the present invention.

The key side housing 20 consists of an upper case 1, a lower case 8 and a printed circuit board 6. The upper case 1 and the lower case 8 are engaged to each other to be opened or closed, and fastened to each other with screws 10 passing through the printed circuit board 6. The key side housing 20 takes also the composition which two external connection terminals 7 and two charge terminals (auxiliary component) 4 overlap to each and are mounted on the printed circuit board 6.

The upper case 1 has two openings (charge openings 2) for inputting charge current to the charge terminals 4 in its top surface and a cut edge (connection opening 3) (shown only one side) for outputting and inputting data to the external connection terminals 7 in its side surface, and is fastened to the lower case 8 with the screws 10.

The lower case 8 has operation buttons mounted in its lower surface, a cut edge (connection opening 9) (shown only one side) opposite the connection opening 3 in its side surface, and the hinge device 8*a* for coupling with the display side housing at one end.

The printed circuit board 6 is contained in the lower case 8 and is fastened to both the upper case 1 and the lower case 8 with the screws 10 passing through the printed circuit board 6.

The external connection terminals 7, when the upper case 1 and the lower case 8 are fastened to each other with the screws 10, are mounted on the printed circuit board 6 so that an electric jack of the external connection terminals 7 is arranged in the position of the connection openings 3 and 9, and are soldered onto an electric conduction pattern of the printed circuit board 6.

The charge terminals 4 are terminals for receiving supply of an electric energy from an external power source into a storage battery incorporated in the mobile terminal device. This charge terminals 4 have a concave portion for overlapping the external connection terminals 7 from the top, and is soldered to a different electric conduction pattern (not shown) of the printed circuit board 6 from the electric conduction pattern to which the external connection terminals 7 are connected electrically.

The relation between the external connection terminals 7 and the charge terminals 4 is explained below. The external connection terminals 7 are first mounted on the printed circuit board 6 to be soldered onto an electric conduction pattern. The charge terminals 4 are then mounted to overlap the external connection terminals 7 from the top with a slight gap, and are soldered onto another electric conduction pattern of the printed circuit board 6. The thickness of the charge terminals 4 is determined so that the gap between the printed circuit board 6 and the upper case 1 is minimized when the upper case 1 and the lower case 8 are fastened to each other.

Furthermore, the external connection terminals 7 and the charge terminals 4 are achieved so that the mounting positions are adjusted to the charge openings 2 of the upper case 1 and the connection openings 3 and 9 corresponding to each of the upper case 1 and the lower case 8.

In the composition described above, when the upper case 1 and the lower case 8 are engaged to each other, the external connection terminals 7 mounted on the printed circuit board 6 can be connected with the external connector through the connection openings 3 and 9, the charge terminals 4 can be inputted a charge current through the charge openings 2. Moreover, the external connection terminals 7 and the charge terminals 4 are located between the printed circuit board 6 and the upper case 1, and the range (flexibility) which moves is restricted mutually. From this, even when the force by insertion and extraction of the external connector is added, a concentration of the force added to the external connection terminals 7 or its mounting potion can be prevented. By preventing the concentration of the force, faults by such as a crack of a solder joint portion and peeling of an electric conduction pattern by the connection of the external connector can be prevented.

Figure 2:
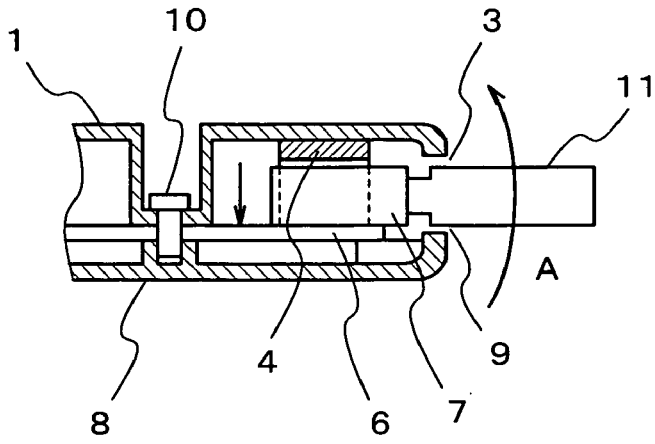
FIG. 2 is a cross-sectional view of a relevant part for explaining direction of a force at the time connected an external connector to the external connection terminal of the external connection terminal fixing structure shown in FIG. 1.

The operation of this embodiment will be described with reference to FIG. 2. FIG. 2 is a cross-sectional view of a relevant part for explaining direction of a force at the time connected an external connector to the external connection terminal of the external connection terminal fixing structure shown in FIG. 1.

The external connector 11 is connected to a front external connection terminal 7 through the connection openings 3 and 9. While the front external connection terminal 7 is connected with the external connector 11, it receives a force by a vibration at the time of movement, a weight of the external connector 11, and a repeat of insertion and extraction of the external connector 11, the front external connection terminal 7 is received particularly a force of the vertical direction (arrow A) as shown in FIG. 2.

A force adding the front external connection terminal 7 by the connection of the external connector 11 is transmitted to the front charge terminal 4 contacted with the front external connection terminal 7 and further transmitted to the upper case 1. Since the upper case 1 is fastened to the lower case 8 by screw 10 passing through the printed circuit board 6, the force is also transmitted to the lower case 8. The force added to the front external connection terminal 7 by the external connector 11 is returned to the printed circuit board 6 as a starting point with the front external connection terminal 7.

The printed circuit board 6 can follow the direction of the force received by the external connector 11 via the front charge terminal 4 and the upper cover 1, by mounting the charge terminals 4 overlapping each of the external connection terminals 7 on the printed circuit board 6. Since there is no concentration of force adding in the connection portion between the printed circuit board 6 and the front external connection terminal 7 by movement of the printed circuit board 6 following the front external connection terminal 7, faults, such as a crack of the solder joint portion or peeling of an electric conduction pattern in the printed circuit board 6 mounting the front external connection terminal 7 can be prevented. Here, even if the charge terminals 4 contact the external connection terminals 7, it can prevent an electric short of both circuits by performing insulated processing by resin et alia to the undersurface in contact with the external connection terminals 7. Considering the external connection terminals 7 and the charge terminals 4 as the parts corresponding to automatic mounting with other parts, a change in the assembling steps of the mobile terminal device is reduced.

Figure 5A:
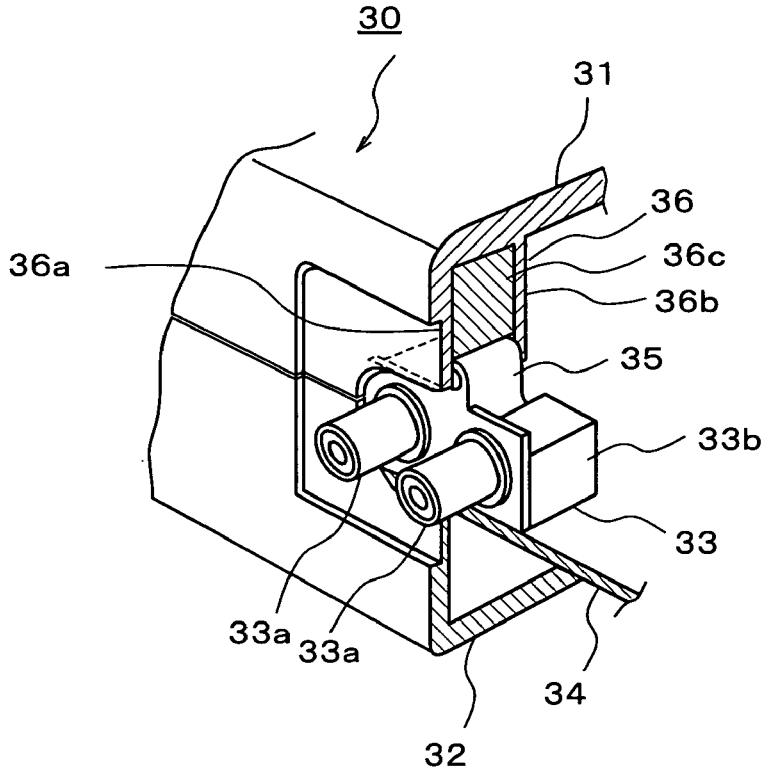
FIGS. 5A and 5B are respectively a perspective view of a relevant part, and a cross-sectional view of a relevant part showing the external connection terminal fixing structure of a prior art electronic device.
Figure 5B:
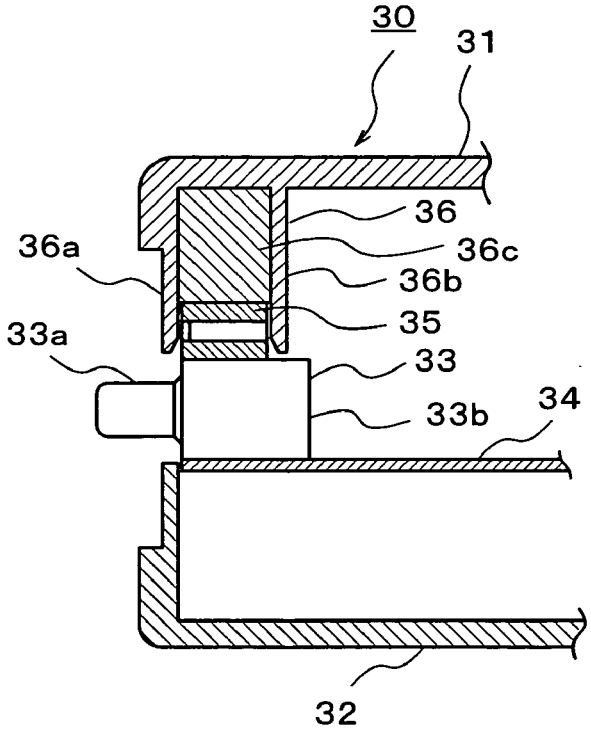

According to this embodiment, as seen in the prior art shown in FIGS. 5A and 5B, it becomes unnecessary to complicate the upper case 1. Here, especially an auxiliary component for preventing a crack of a solder joint portion and peeling of an electric conduction pattern fixing the external connection terminals 7 is not necessary to provide a charge function.

Figure 3:
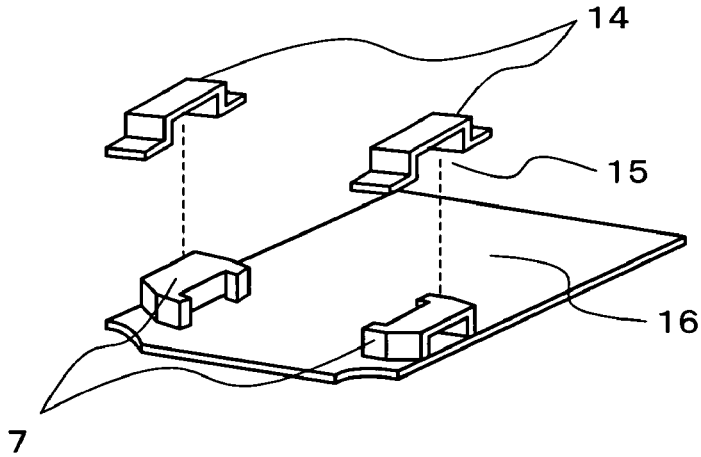
FIG. 3 is a perspective view showing mounting state of the external connection terminal of the external connection terminal fixing structure of a second embodiment of the present invention.

A second embodiment of the present invention will be described below. FIG. 3 is a perspective view showing mounting state of external connection terminal of an external connection terminal fixing structure of a second embodiment of the present invention.

The second embodiment is different from FIG. 1 in that an auxiliary component (bracket) does not have a charge function. The description of the components except for parts mounted on the printed circuit board 6 is omitted.

In FIG. 3, two external connection terminals 7 are mounted on the printed circuit board 16 and are connected to an electric conduction pattern of the printed circuit board 16 by soldering. The external connection terminals 7, as in FIG. 1, are connected with the external connectors 11 through the connection openings 3 and 9 of the upper case 1 and the lower case 8.

The brackets 14 are mounted in place of the charge terminals 4 of FIG. 1. The brackets 14 have a concave portion for overlapping the external connection terminals 7 from the top, and is soldered to a different electric conduction pattern (not shown) of the printed circuit board 16 from the electric conduction pattern to which the external connection terminals 7 was connected electrically. The brackets 14 overlap the external connection terminals 7 with a slight gap. The thickness of the brackets 14 is determined so that the gap between the printed circuit board 16 and the upper case 1 is minimized when the upper case 1 and the lower case 8 are fastened to each other. The brackets 14 are used in place of the charge terminals 4 when the charge function is unnecessary. As in the charge terminals 4, it can prevent an electric short of both circuits by performing insulated processing by resin et alia to the undersurface of the brackets 14 in contact with the external connection terminals 7.

Figure 4:
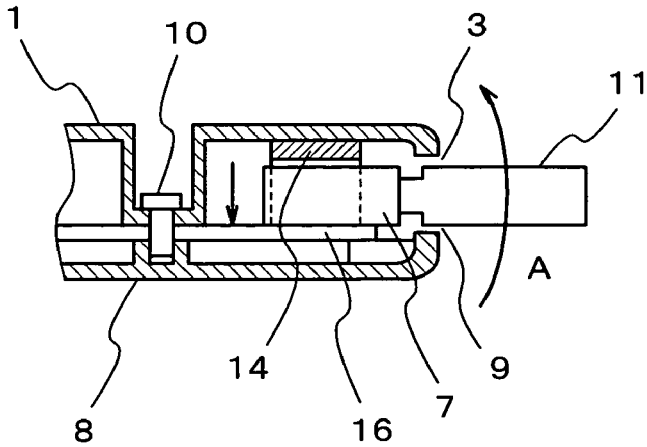
FIG. 4 is a cross-sectional view of a relevant part for explaining direction of a force at the time connected an external connector to the external connection terminal of the external connection terminal fixing structure shown in FIG. 3.

The operation of this embodiment will be described with reference to FIG. 4. FIG. 4 is a cross-sectional view of a relevant part for explaining direction of a force at the time connected an external connector to the external connection terminal of the external connection terminal fixing structure shown in FIG. 3.

The front external connection terminal 7 is connected through the connection openings 3 and 9 with the external connector 11. While the external connector 11 is connected to the front external connection terminal 7, when the front external connection terminal 7 receives a force in the vertical direction (arrow A) as shown in FIG. 4, it is going to move in the direction leaving from the printed circuit board 16.

As in the embodiment shown in FIG. 2, a force adding the front external connection terminal 7 by the connection of the external connector 11 is transmitted to the front bracket 14 contacted with the front external connection terminal 7 and is further transmitted to the upper case 1 contacted with the front bracket 14. Since the upper case 1 is fastened to the lower case 8 by screw 10 passing through the printed circuit board 6, the force is also transmitted to the lower case 8. Therefore, since the force applied to the front external connection terminal 7 by the external connector 11 returns to the printed circuit board 6 mounting the front external connection terminal 7 as the starting point, the whole key side case 20 follows it in the direction of force.

Since there is no concentration of force adding the external connection terminals 7 or a connection portion, faults, such as a crack of the solder joint portion or peeling of an electric conduction pattern in the printed circuit board 16 mounting the external connection terminals 7 can be prevented.

In case of the second embodiment, the bracket as aboard-like component without a charge function is used instead of the charge terminal of the first embodiment mentioned above. The force of the exfoliation direction joining the external connection terminal like the first embodiment is absorbable by the whole key side housing 20.

In the embodiments above-mentioned, two external connection terminals are mounted on the printed circuit board. However, the external connection terminals are mounted not only two but one, three or more, and the auxiliary component is used for absorbing a force of joining the external connection terminal according to its number. It is also possible to make the auxiliary component a screw cramp in place of soldering.

While this invention has been described in connection with certain preferred embodiments, it is to be understood that the subject matter encompassed by way of this invention is not to be limited to those specific embodiments. On the contrary, it is intended for the subject matter of the invention to include all alternative, modification and equivalents as can be included within the spirit and scope of the following claims.

What is claimed is:

1. An external connection terminal fixing structure comprising:

a printed circuit board, a lower case and an upper case containing said printed circuit board, an external connection terminal fixed to said printed circuit board and configured to connect with an external connector, and an auxiliary component overlapped with said external connection terminal and contacted with said upper case, wherein said auxiliary component has a thickness enough to bridge a gap between said printed circuit board and said upper case and is fixed to said printed circuit board by soldering.

2. The external connection terminal fixing structure according to claim 1, wherein said lower case and said upper case have a cut edge (opening) at the position where said external connection terminal is fixed to said printed circuit board so that one side of said external connection terminal is exposed.

3. The external connection terminal fixing structure according to claim 2, wherein said external connection terminal provides an electric jack which an external connector is connected through said cut edge and is fixed to an electric conduction pattern of said printed circuit board by soldering.

4. The external connection terminal fixing structure according to claim 1, wherein said upper case has an opening at the position where said auxiliary component contacts to said upper case so that one side of said auxiliary component is outside exposed.

5. The external connection terminal fixing structure according to claim 4, wherein said auxiliary component has an electrode surface inputting a charge current through said opening, a concave portion for overlapping said external connection terminal from the top, and is mounted onto an electric conduction pattern of said printed circuit board.

6. A mobile terminal device in which the external connection terminal fixing structure according to claim 1 is incorporated as a unit of device components.

7. A mobile terminal device in which the external connection terminal fixing structure according to claim 2 is incorporated as a unit of device components.

8. A mobile terminal device in which the external connection terminal fixing structure according to claim 3 is incorporated as a unit of device components.

9. A mobile terminal device in which the external connection terminal fixing structure according to claim 4 is incorporated as a unit of device components.

10. A mobile terminal device in which the external connection terminal fixing structure according to claim 5 is incorporated as a unit of device components.

11. A mobile terminal device, comprising:

a key side housing (20), the key side housing comprising an upper case (1) engaged with a lower case (8), and a printed circuit board (6) therebetween;

an external connection terminal fixing structure (7) fixed to the printed circuit board and having an end face located completely interior to the key side housing, the external connection terminal fixing structure configured to connect with an external connector (11) inserted into an opening of the key side housing and into the end face of the external connection terminal fixing structure; and an auxiliary component (4) overlapping the external connection terminal fixing structure, the auxiliary component mounted on the printed circuit board and arranged inside the opening and between the external connection terminal fixing structure and an interior side of the upper case, wherein said auxiliary component has a thickness sufficient to bridge a gap between said printed circuit board and said upper case and is fixedly soldered to said printed circuit board and electrically isolated from the external connection terminal fixing structure.

12. The device of claim 11, wherein, the external connection terminal fixing structure comprises two external connection terminals (7) configured to connect with the external connector, and the auxiliary component is a charge terminal (4) overlapping each of the external terminals, each charge terminal being a terminal for receiving supply of an electric energy from an external power source into a storage battery incorporated in the mobile terminal device.

13. The device of claim 12, wherein, the upper case has two charge openings (2) for inputting charge current to the charge terminals in a top surface of the upper case, and the upper case has a cut edge connection opening (3), for outputting and inputting data to the external connection terminals (7).

14. The device of claim 11, wherein, the upper case and the lower case are engaged to each other to be opened or closed and fastened to each other via screws passing through the printed circuit board, and further comprising a hinge device (8*a*) for foldably coupling the key side housing to a display side housing.

15. The device of claim 14, wherein, the external connection terminals (7) each comprise an electric jack, the external connection terminals are mounted on the printed circuit board so that the electric jack of each external connection terminal is arranged in the position of the connection openings.

16. The device of claim 11, wherein, the auxiliary component (4) overlaps the external connection terminal fixing structure (7) by bridging between the lower case and the upper case to close any gap therebetween in a vicinity of the external connection terminal fixing structure and restrict a range of flexible movement of the external connection terminal fixing structure under force of insertion and extraction of the external connector.

17. The device of claim 11, wherein, the external connection terminal fixing structure comprises an external connection terminal (7) configured to connect with the external connector at a front face of the external connection terminal, the front face being interior to the opening of the housing, and with the external connection terminal connected with the external connector, the external connection terminal receives a force by a vibration at a time of movement of the external connector and a weight of the external connector as a force of a vertical direction, the force is transmitted to the auxiliary component and further transmitted to the upper case, to the lower case, and to the printed circuit board.

18. A mobile terminal device, comprising:

a device housing (20), the housing comprising an upper case (1) engaged with a lower case (8), and a printed circuit board (6) therebetween;

an external connection terminal (7) fixed to the printed circuit board, the external connection terminal configured to connect with an external connector (11) inserted proximate an opening of the housing and toward an end face of the external connection terminal; and an auxiliary bridging component (4) overlapping the external connection terminal, the auxiliary component mounted on the printed circuit board and arranged inside the opening and between the external connection terminal fixing structure and an interior side of the upper case, wherein said auxiliary bridging component has a thickness sufficient to bridge a gap between said printed circuit board and said upper case and is configured to transmit forces received by the external connection terminal being connected with the external connector, the external connection terminal receiving forces by a vibration at a time of movement of the external connector and a weight of the external connector, the forces transmitted to the auxiliary bridging component and further transmitted to the upper case, to the lower case, and to the printed circuit board, the auxiliary bridging component is a charge terminal connected to receive a supply of an electric energy from an external power source into a storage battery incorporated in the mobile terminal device, and the charge terminal has a concave portion overlapping a top side of the external connection terminal and soldered to the printed circuit board.

19. The device of claim 18, wherein, the auxiliary bridging component (4) overlaps the external connection terminal (7) by bridging between the lower case and the upper case to bridge any gap therebetween in a vicinity of the external connection terminal fixing structure and restrict a range of flexible movement of the external connection terminal fixing structure under forces of insertion and extraction of the external connector.

20. The device of claim 18, wherein, the concave portion overlapping the external connection terminal is soldered to a part of the printed circuit board electrically separate from a electric conduction pattern to which the external connection terminal is electrically connected, there are two external connection terminals with two corresponding charge terminals, the upper case further comprising two charge openings, each charge opening exposing one charge terminal to input charge current to the exposed one charge terminal.

* * * * *